US011814875B2

(12) United States Patent
Chen

(10) Patent No.: US 11,814,875 B2
(45) Date of Patent: Nov. 14, 2023

(54) CONTROL STRUCTURE OF DOOR LOCK

(71) Applicant: Jeff Chen, Chiayi (TW)

(72) Inventor: Jeff Chen, Chiayi (TW)

( * ) Notice: Subject to any disclaimer, the term of this patent is extended or adjusted under 35 U.S.C. 154(b) by 92 days.

(21) Appl. No.: 17/515,699

(22) Filed: Nov. 1, 2021

(65) Prior Publication Data

US 2023/0135493 A1 May 4, 2023

(51) Int. Cl.

| | |
|---|---|
| ***E05B 47/00*** | (2006.01) |
| ***E05B 55/00*** | (2006.01) |
| ***E05B 63/08*** | (2006.01) |
| ***E05B 47/02*** | (2006.01) |
| ***E05B 63/00*** | (2006.01) |

(52) U.S. Cl.

CPC ..... *E05B 47/0012* (2013.01); *E05B 47/026* (2013.01); *E05B 55/005* (2013.01); *E05B 63/08* (2013.01); *E05B 63/0056* (2013.01)

(58) Field of Classification Search

CPC .. E05B 47/00; E05B 47/0001; E05B 47/0012; E05B 47/026; E05B 2047/0013; E05B 55/00; E05B 55/005; E05B 63/00; E05B 63/0056; E05B 63/006; E05B 63/10

USPC ..... 70/277

See application file for complete search history.

(56) References Cited

U.S. PATENT DOCUMENTS

| | | | | |
|---|---|---|---|---|
| 8,544,903 | B1 * | 10/2013 | Shamp | E05B 63/10 292/1.5 |
| 2010/0263418 | A1 * | 10/2010 | Moon | E05B 63/16 292/61 |
| 2012/0013135 | A1 * | 1/2012 | Moon | E05B 17/2026 292/165 |
| 2017/0275926 | A1 * | 9/2017 | Kumar | E05B 55/12 |

* cited by examiner

*Primary Examiner* — Nathan Cumar

(57) ABSTRACT

A control structure of a door lock contains: a body, a slidable partition, a motor, a slide cylinder, a deadbolt, a latch, a first resilient element, and a second resilient element. The body includes a first cap, a second cap, an open segment, a close segment, a drive space, a holder, a groove, and an abutting post. The slidable partition is accommodated in the body and includes a slot, two spaced first driving extensions, a second driving extension, a through hole, two symmetrical hooks, and a seat. The motor is accommodated in the holder. The slide cylinder is received in the drive space. The deadbolt is movably received in the opening. The latch is accommodated in the notch. The first resilient element is positioned on the second positioning segment and the first positioning segment. The second resilient element is positioned on the first locating protrusion.

3 Claims, 12 Drawing Sheets

CONTROL STRUCTURE OF DOOR LOCK

BACKGROUND OF THE INVENTION

Field of the Invention

The present invention relates to a control structure of a door lock which contains a motor configured to drive a deadbolt to move outward or retract backward with respect to an open segment of a body easily, and the control structure contains a first cap and a second cap which is integrally formed respectively so as to obtain structural reinforcement to avoid easy deformation, wherein the control structure contains the deadbolt pushed forward by a latch.

Description of the Prior Art

A conventional door lock is connected by several components, so it is operated badly after a period of using time. Furthermore, the conventional deadbolt is deformed easily after being hit.

The present invention has arisen to mitigate and/or obviate the afore-described disadvantages.

SUMMARY OF THE INVENTION

The primary object of the present invention is to provide a control structure of a door lock which contains a motor configured to drive a deadbolt to move outward or retract backward with respect to an open segment of a body easily.

Further object of the present invention is to provide a control structure of a door lock which contains a first cap and a second cap which is integrally formed respectively so as to obtain structural reinforcement to avoid easy deformation.

Another object of the present invention is to provide a control structure of a door lock which contains the deadbolt pushed forward by a latch.

To obtain above-mentioned aspect, a control structure of a door lock provided by the present invention contains: a body, a slidable partition, a motor, a slide cylinder, a deadbolt, a latch, a first resilient element, and a second resilient element.

The body includes a first cap, a second cap, an open segment, a close segment, a drive space, a holder, a groove, and an abutting post.

The slidable partition is accommodated in the body, and the slidable partition includes a slot, two spaced first driving extensions, a second driving extension, a through hole, two symmetrical hooks, a seat, a drive orifice, a first paw, a second paw, and a shaft. The shaft has a hole corresponding to the drive orifice.

The motor is accommodated in the holder of the body, the motor includes a guide rod, and a side wall of the motor is positioned by the abutting post of the body.

The slide cylinder is received in the drive space of the body. The slide cylinder includes an opening and a fixing segment. The fixing segment has a fence, a guide orifice, a trench, two troughs, at least one horizontal trench, a first positioning segment, and a first locating protrusion.

The deadbolt is fixed in the body and is movably received in the opening of the slide cylinder. The deadbolt includes a locking segment, a chamber.

The latch is accommodated in the notch of the deadbolt, and the latch includes a lock fringe and a second location protrusion.

A first end of the first resilient element is positioned on the second positioning segment of the slide cylinder, and a second end of the first resilient element is fixed on the first positioning segment of the deadbolt.

A first end of the second resilient element is positioned on the first locating protrusion of the slide cylinder, and a second end of the second resilient element is fixed on the second location protrusion of the latch.

DETAILED DESCRIPTION OF THE PREFERRED EMBODIMENTS

Figure 1:
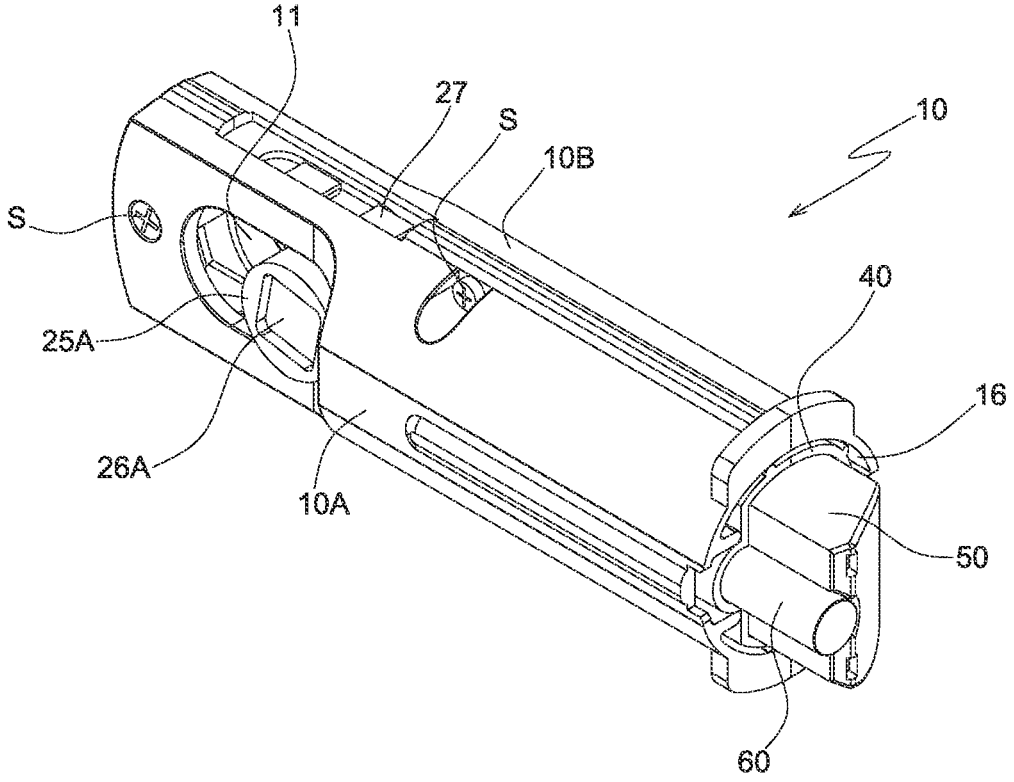
FIG. 1 is a perspective view showing the assembly of a control structure of a door lock according to a preferred embodiment of the present invention.
Figure 2:
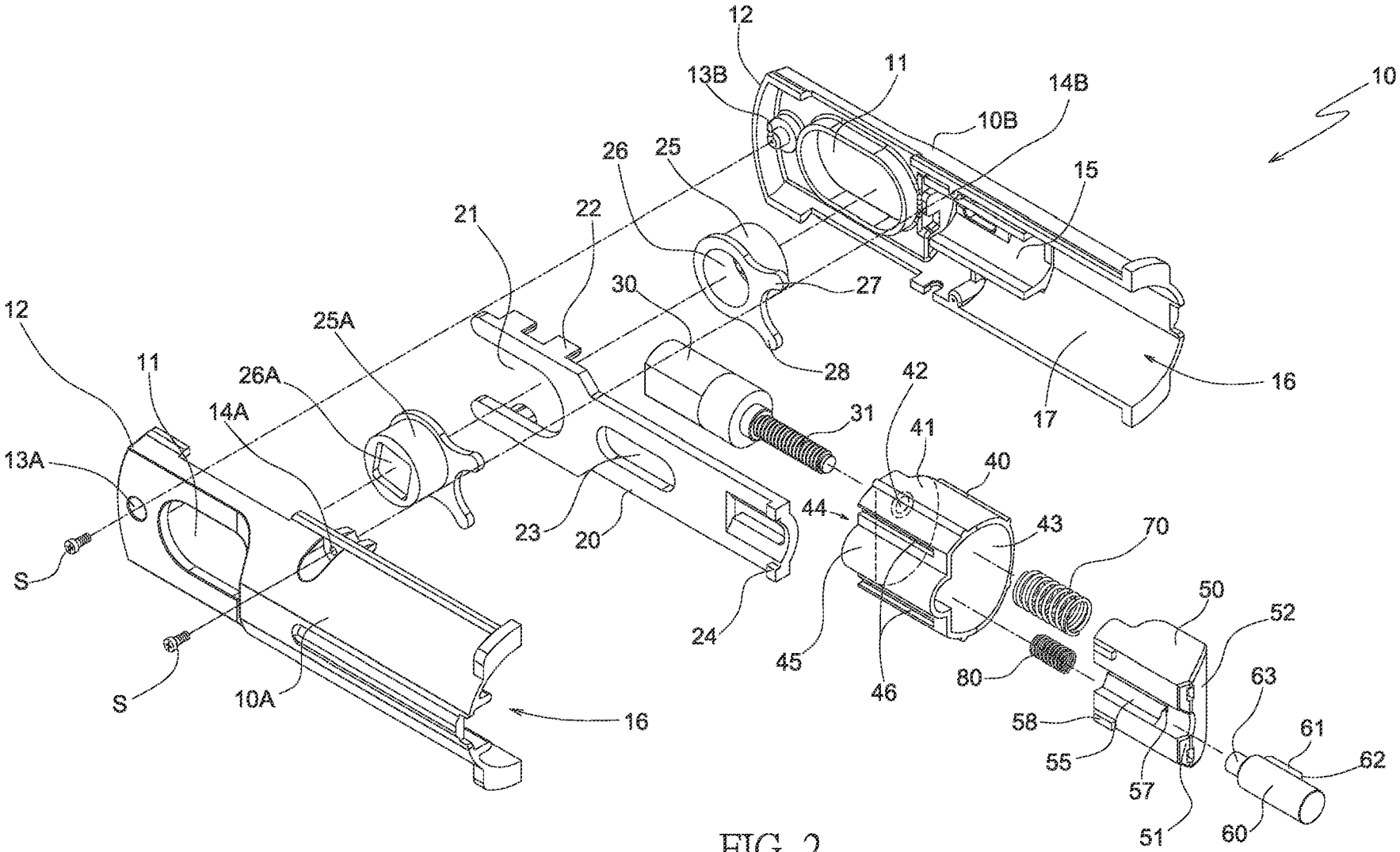
FIG. 2 is a perspective view showing the exploded components of the control structure of the door lock according to the preferred embodiment of the present invention.
Figure 3:
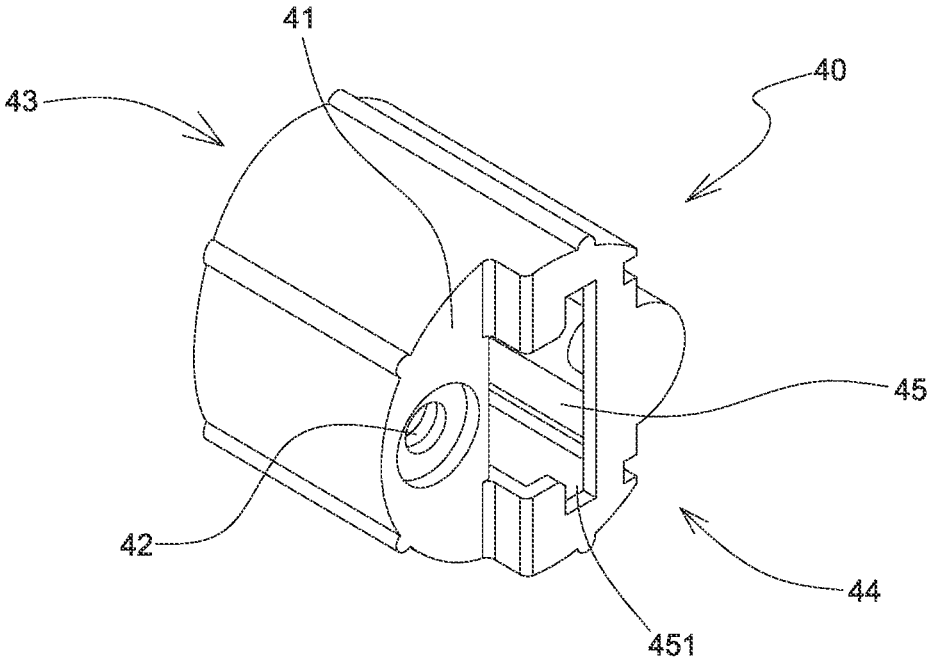
FIG. 3 is a perspective view showing the assembly of a slide cylinder of the control structure of the door lock according to the preferred embodiment of the present invention.
Figure 4:
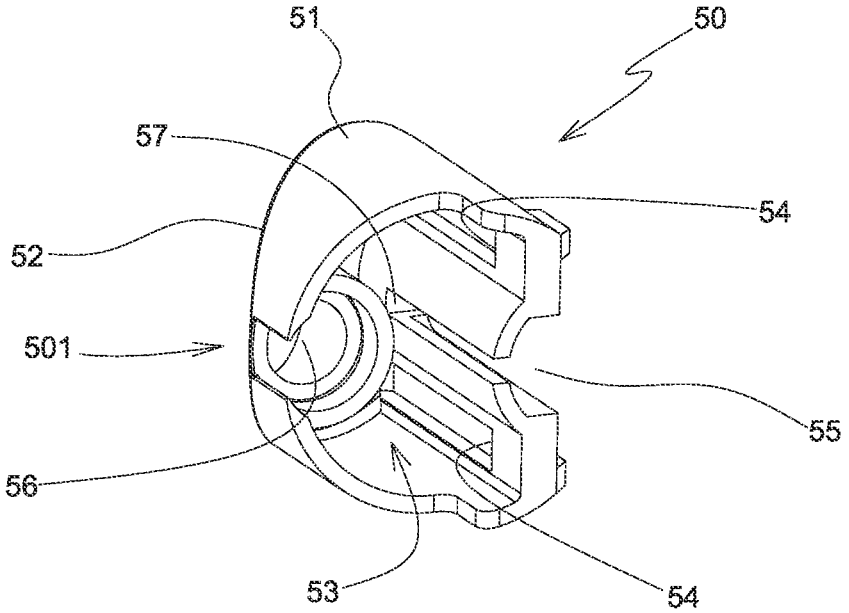
FIG. 4 is a perspective view showing the assembly of a deadbolt of the control structure of the door lock according to the preferred embodiment of the present invention.

The present invention will be clearer from the following description when viewed together with the accompanying drawings, which show, for purpose of illustrations only, a preferred embodiment in accordance with the present invention.

With reference to FIGS. 1-19, a control structure of a door lock according to a preferred embodiment of the present invention comprises:

a body 10 including a first cap 10A and a second cap 10B, each of the first cap 10A and the second cap 10B being integrally formed, the body 10 further including an open segment 16 formed on a first end thereof, a close segment 12 formed on a second end of the body 10, a drive space 17 defined in the body 10, a holder 15 formed inside the drive space 17 of the body 10, a groove 11 formed inside the body 10 adjacent to the close segment 12, and an abutting post 18 extending from the first cap 10A; wherein the first cap 10A and the second cap 10B of the body 10 are connected, the first cap 10A has a first connection portion 13A and a first coupling portion 14A, the second cap 10B has a second connection portion 13B and a second coupling portion 14B corresponding to the first connection portion 13A and the first coupling portion 14A, such that the first connection portion 13A and the first coupling portion 14A are connected by using a screw bolt S, and the second connection portion 13B and the second coupling portion 14B are connected by way of another screw bolt S, thus connecting the first cap 10A and the second cap 10B to produce the body 10;

a slidable partition 20 accommodated in the body 10, and the slidable partition 20 including a slot 21 defined on a first end of the slidable partition 20 and corresponding to the groove 11 of the body 10, two spaced first driving extensions 22 extending above the slot 21, a second driving extension 22A extending below the slot 21, a through hole 23 defined on a predetermined position of an intermediate section of the slidable partition 20 and receiving the abutting post 18, two symmetrical hooks 24 extending from a second end of the slidable partition 20 and aligning with the open segment 16 of the body 10, a seat 25 extending from the slot 21 and corresponding to the groove 11 of the body 10, a drive orifice 26 defined in the seat 25, a first paw 27 extending from the seat 25 and corresponding to the two first spaced driving extensions 22 of the slidable partition 20, a second paw 28 extending from the seat 25 and corresponding to the second driving extension 22A, and a shaft 25A extending from the seat 25 opposite to the first paw 27 and the second paw 28, wherein the shaft 25A has a hole 26A corresponding to the drive orifice 26;

a motor 30 accommodated in the holder 15 of the body 10, the motor 30 including a guide rod 31 extending from a center of an end of the motor 30 corresponding to the open segment 16 of the body 10, wherein a side wall of the motor 30 is positioned by the abutting post 18 of the body 10;

a slide cylinder 40 received in a predetermined position of the drive space 17 of the body 10, the slide cylinder 40 including an opening 43 defined on a first end of the slide cylinder 40 and corresponding to the open segment 16 of the body 10, a fixing segment 44 formed on a second end of the slide cylinder 40, the fixing segment 44 having a fence 41, a guide orifice 42 defined on a side of the fence 41 and configured to mesh with the guide rod 31 of the motor 30, a trench 45 formed proximate to the guide orifice 42, two troughs 451 defined on a top and a bottom of the trench 45, wherein the trench 45 and the two troughs 451 accommodate the slidable partition 20, and the slide cylinder 40 further includes at least one horizontal trench 46 passing through the slot 21, a first positioning segment 47 formed on the fence 41 of the slide cylinder 40 adjacent to the guide orifice 42, and a first locating protrusion 48 formed on the fence 41 of the slide cylinder 40 away from the first positioning segment 47;

a deadbolt 50 fixed in the body 10 and movably received in the opening 43 of the slide cylinder 40, and the deadbolt 50 including a locking segment 501 defined on a first end of the deadbolt 50, a chamber 53 formed in a second end of the deadbolt 50, wherein the locking segment 501 has a tip portion 51 and a tilted face 52 defined on a tip portion 51; the chamber 53 has a second positioning segment 56 corresponding to the first positioning segment 47 of the slide cylinder 40, a notch 55 defined on a side of the deadbolt 50, an engagement segment 57 formed in the notch 55 opposite to a center of the chamber 53, two retaining portions 54 arranged on a top and a bottom of the chamber 53 and corresponding to the two symmetrical hooks 24, and at least one locking tabs 58 corresponding to and engaging with the at least one horizontal trench 46 of the slide cylinder 40;

a latch 60 accommodated in the notch 55 of the deadbolt 50, a lock fringe 61 formed on a side of the latch 60, wherein a slanted guiding face 62 is formed on an edge of the locking lock fringe 61, and the locking lock fringe 61 is movably engaged with the engagement segment 57 of the deadbolt 50, wherein the latch 60 further includes a second location protrusion 63 extending from a distal end of the latch 60;

a first resilient element 70, a first end of the first resilient element 70 is positioned on the second positioning segment 56 of the slide cylinder 40, and a second end of the first resilient element 70 is fixed on the first positioning segment 47 of the deadbolt 50; and a second resilient element 80, a first end of the second resilient element 80 is positioned on the first locating protrusion 48 of the slide cylinder 40, and a second end of the second resilient element 80 is fixed on the second location protrusion 63 of the latch 60.

Figure 5:
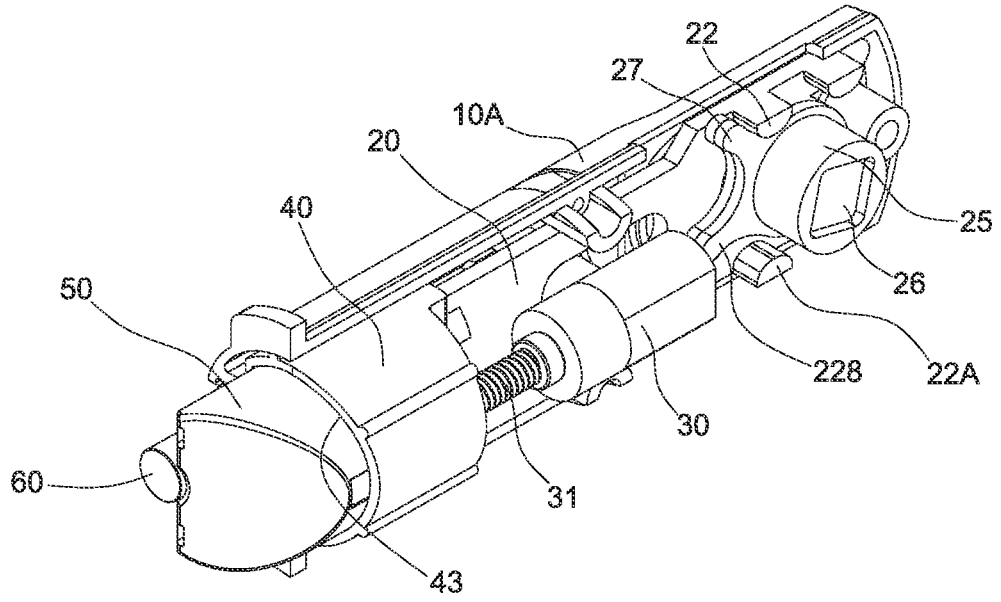
FIG. 5 is a perspective view showing the operation of the deadbolt of the control structure of the door lock according to the preferred embodiment of the present invention.
Figure 6:
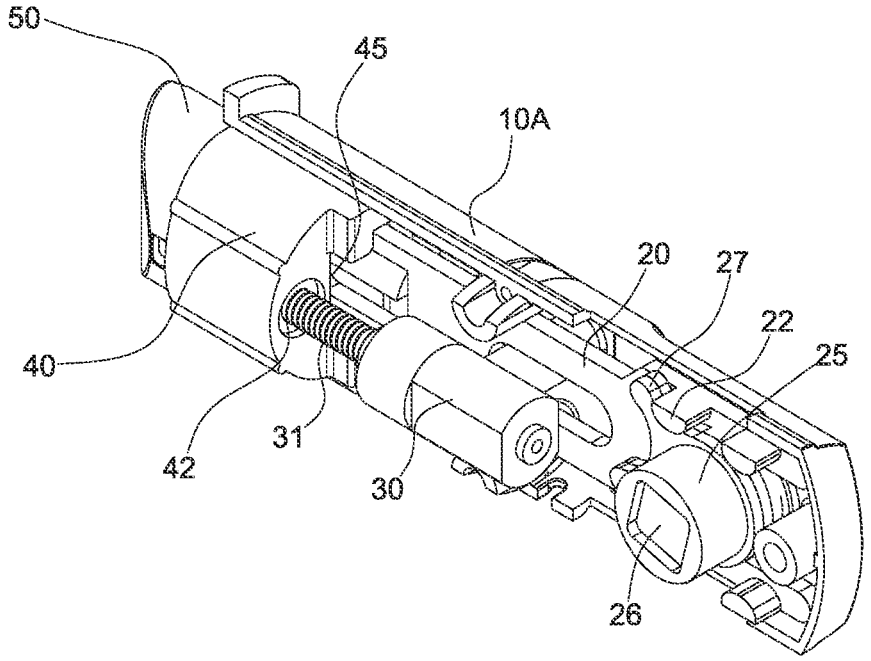
FIG. 6 is another perspective view showing the operation of the deadbolt of the control structure of the door lock according to the preferred embodiment of the present invention.
Figure 7:
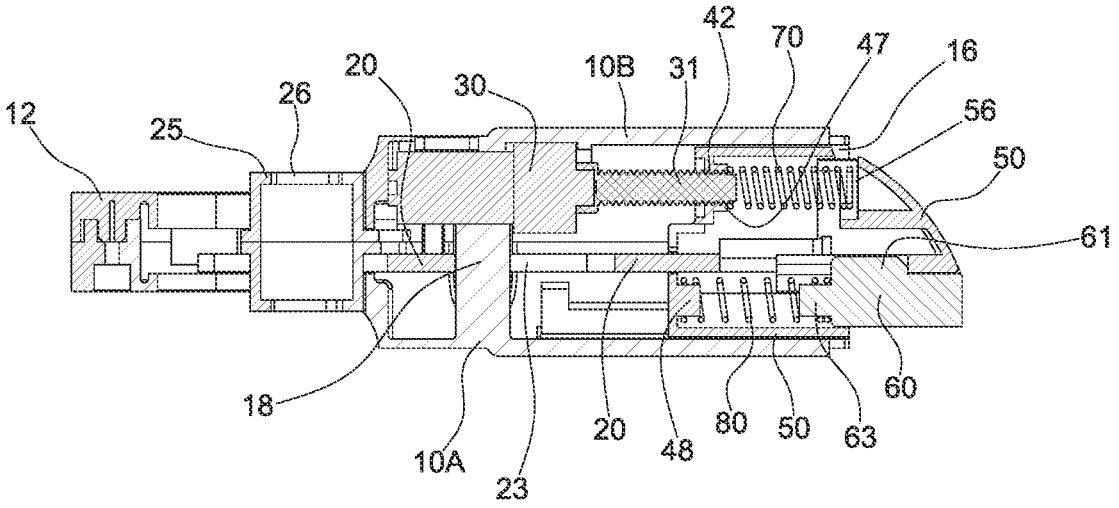
FIG. 7 is a cross sectional view showing the operation of the deadbolt of the control structure of the door lock according to the preferred embodiment of the present invention.
Figure 8:
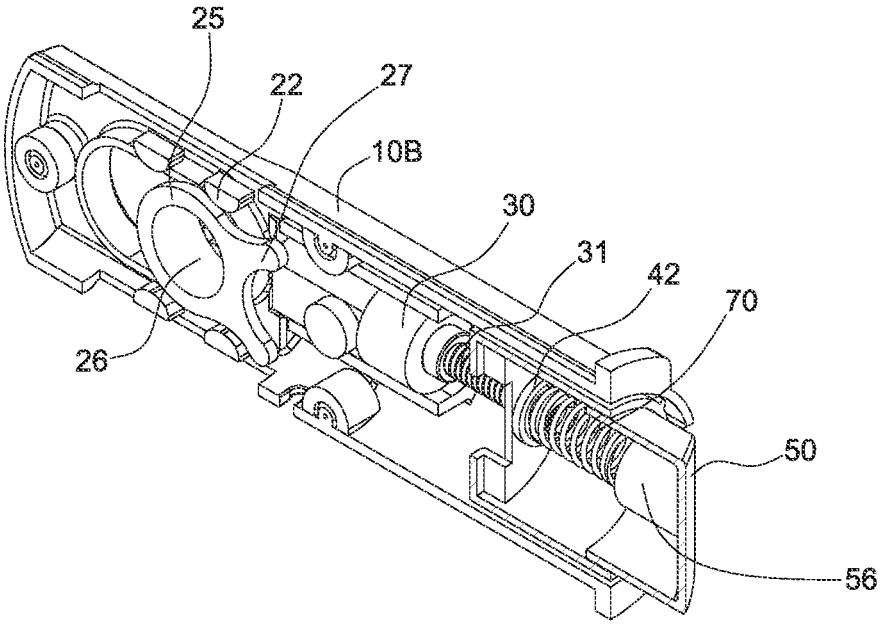
FIG. 8 is a cross-sectional perspective view showing the operation of the deadbolt of the control structure of the door lock according to the preferred embodiment of the present invention.

Referring to FIGS. 5-6, the deadbolt 50 is driven electrically to extend outward. The motor 30 of the control structure of the door lock is driven by a controlling signal of an electric circuit of a control unit A1 so as to drive the guide rod 31 to rotate, and the guide rod 31 actuates the guide orifice 42 of the slide cylinder 40 so that the slide cylinder 40 drives the deadbolt 50 to extend out of the open segment 16 of the body 10, as shown in FIGS. 7-8, when the slide cylinder 40 moves forward, the slide cylinder 40 pushes the deadbolt 50 to extend out of the open segment 16 of the body 10 by way of the first resilient element 70.

Figure 9:
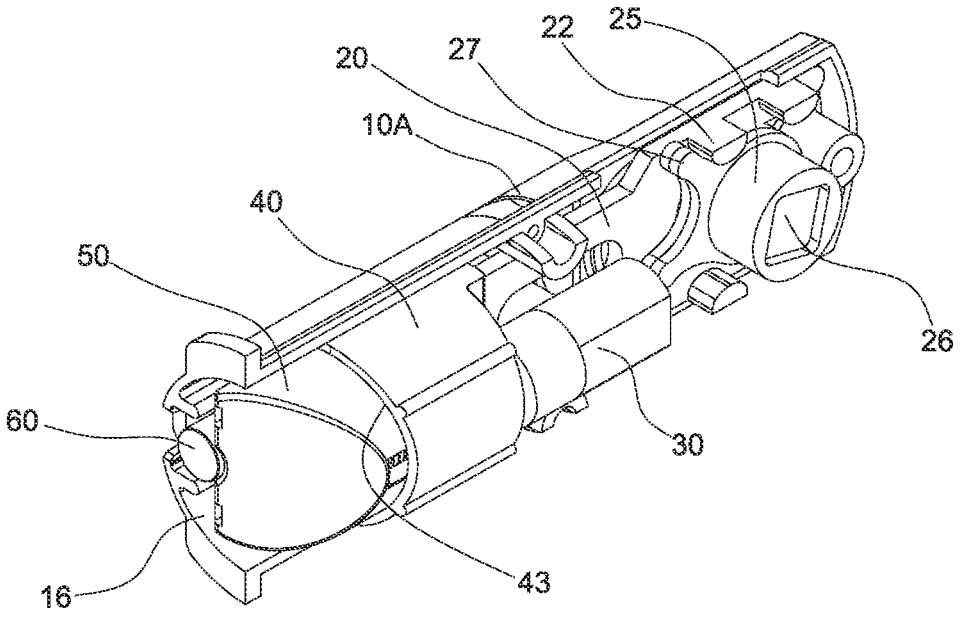
FIG. 9 is also another perspective view showing the operation of the deadbolt of the control structure of the door lock according to the preferred embodiment of the present invention.
Figure 10:
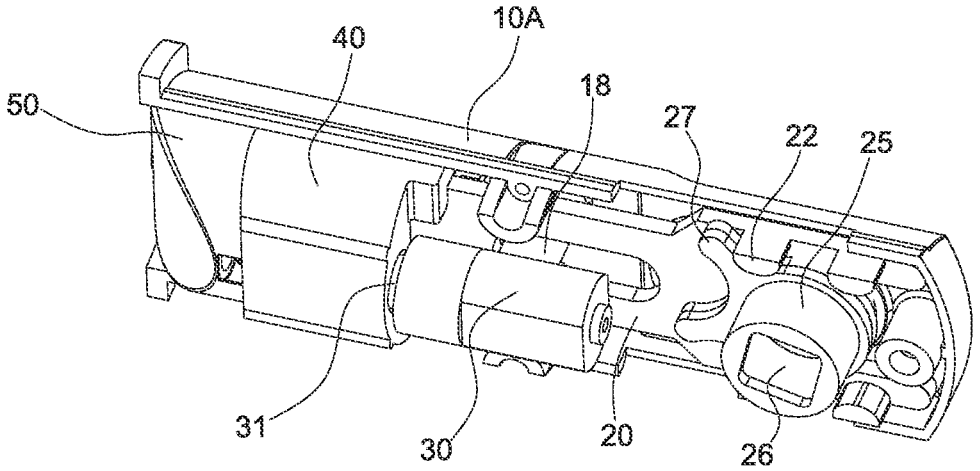
FIG. 10 is still another perspective view showing the operation of the deadbolt of the control structure of the door lock according to the preferred embodiment of the present invention.
Figure 11:
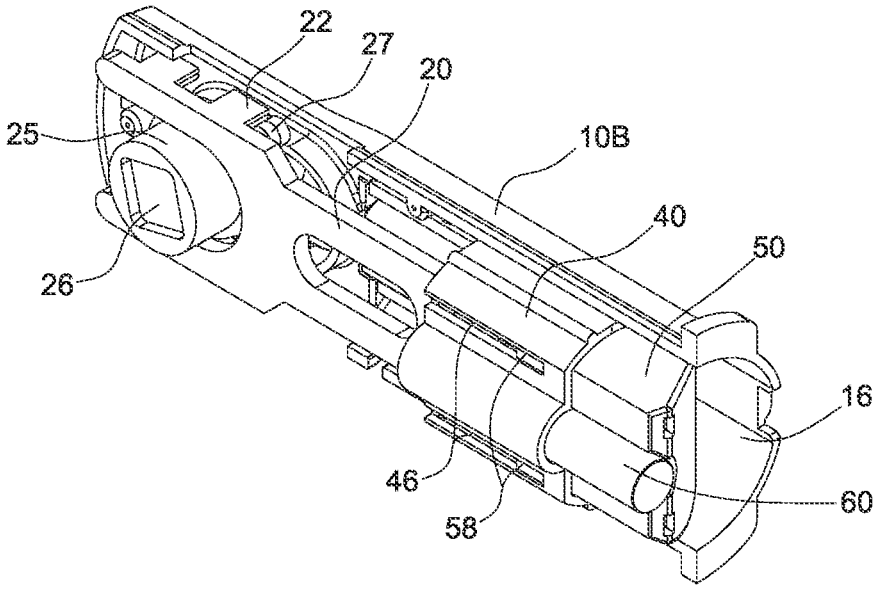
FIG. 11 is another perspective view showing the operation of the deadbolt of the control structure of the door lock according to the preferred embodiment of the present invention.
Figure 12:
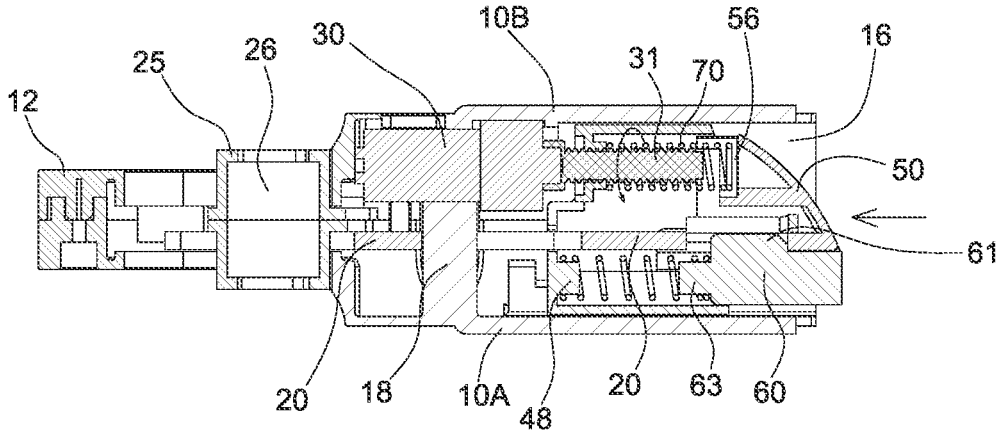
FIG. 12 is a cross sectional view showing the operation of the deadbolt of the control structure of the door lock according to the preferred embodiment of the present invention.

As illustrated in FIGS. 9-10, the deadbolt 50 is driven electrically to retract backward, wherein the motor 30 rotates reversely to actuate the guide rod 31 so that the guide rod 31 drives the guide orifice 42 of the slide cylinder 40, and the slide cylinder 40 actuates the deadbolt 50 to retract back to the open segment 16 of the body 10, as shown in FIGS. 11-12, when the slide cylinder 40 retracts backward, the at least one horizontal trench 46 of the slide cylinder 40 engages with the at least one locking tabs 58 of the deadbolt 50 so that the slide cylinder 40 drives the deadbolt 50 to retract back to the open segment 16 of the body 10.

Figure 13:
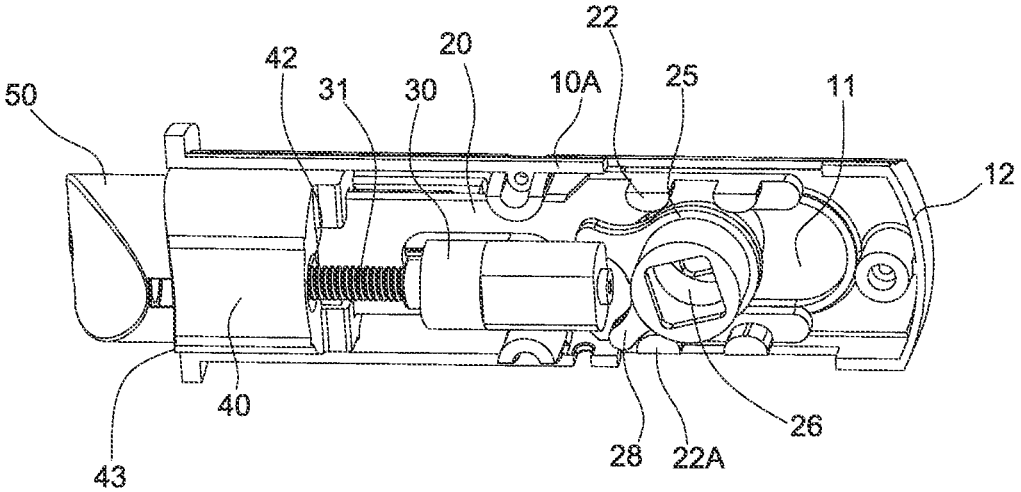
FIG. 13 is also another perspective view showing the operation of the deadbolt of the control structure of the door lock according to the preferred embodiment of the present invention.
Figure 14:
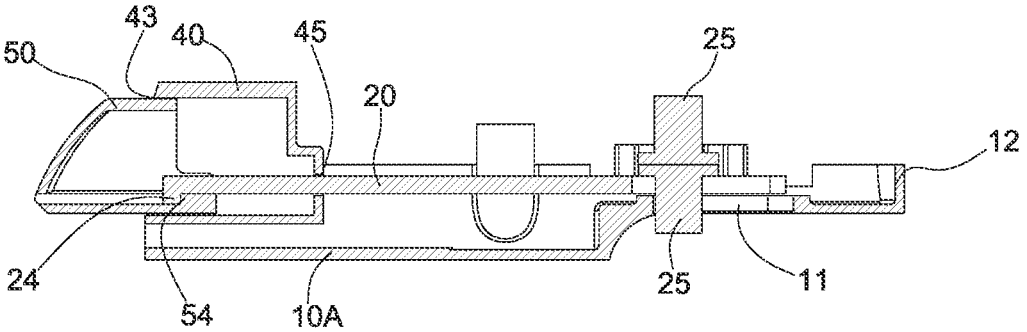
FIG. 14 is a cross sectional view showing the operation of the deadbolt of the control structure of the door lock according to the preferred embodiment of the present invention.

Referring to FIGS. 13-14, the deadbolt 50 is driven manually to extend outward, wherein the hole 26A of the shaft 25A and the drive orifice 26 of the seat 25 are noncircular and are connected with a driven column A21, wherein the driven column A21 has two lock knobs A2 on two free ends thereof. When the two lock knobs A2 are rotated manually, the seat 25 and the shaft 25A are driven to rotate clockwisely or counterclockwise. When the seat 25 and the shaft 25A are rotated clockwisely, the second paw 28 actuates the second driving extension 22A of the slide partition 20 so that the slidable partition 20 moves forward to drive the two retaining portions 54 of the deadbolt 50 to push the deadbolt 50, and the deadbolt 50 extends out of the open segment 16 of the body 10.

Figure 15:
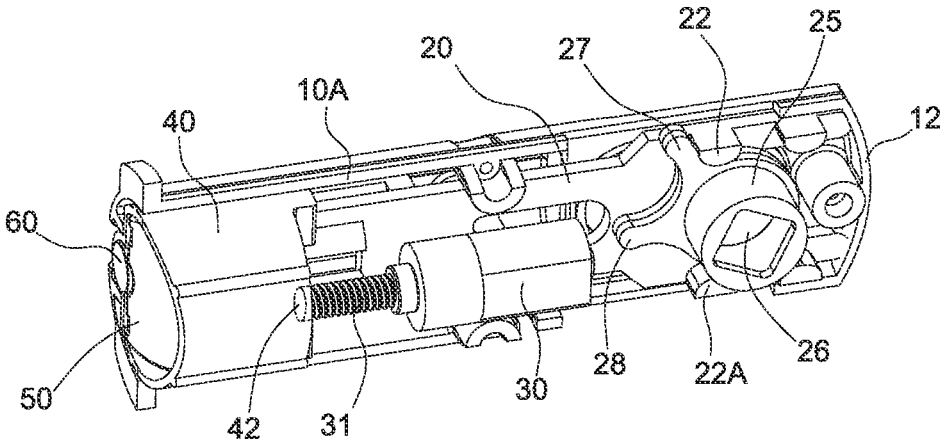
FIG. 15 is a perspective view showing the operation of the deadbolt of the control structure of the door lock according to the preferred embodiment of the present invention.
Figure 16:
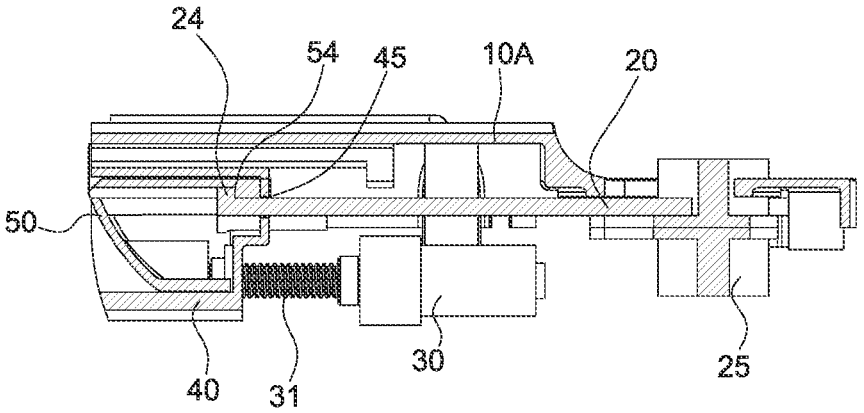
FIG. 16 is a cross sectional view showing the operation of the deadbolt of the control structure of the door lock according to the preferred embodiment of the present invention.

With reference to FIGS. 15-16, the deadbolt 50 is driven manually to retract backward. When the seat 25 and the shaft 25A are rotated counterclockwise, the first paw 27 actuates the two first spaced driving extensions 22 of the slidable partition 20 so that the slide partition 20 moves backward to urge the two symmetrical hooks 24, and the two symmetrical hooks 24 drive the two retaining portions 54 of the deadbolt 50 to retract backward.

Figure 17:
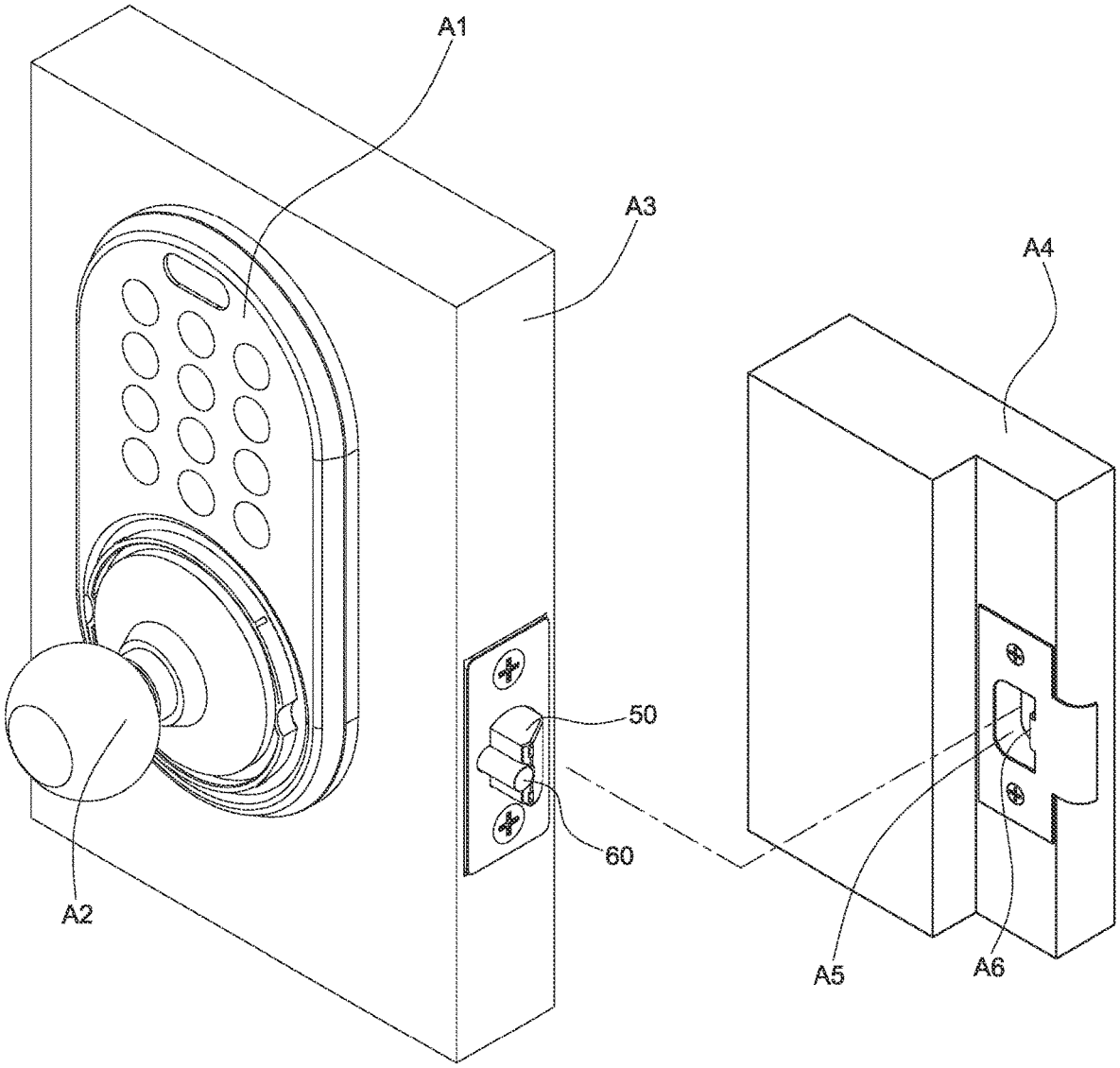
FIG. 17 is a perspective view showing the control structure of the door lock being applicable for a door and a door frame according to the preferred embodiment of the present invention.
Figure 18:
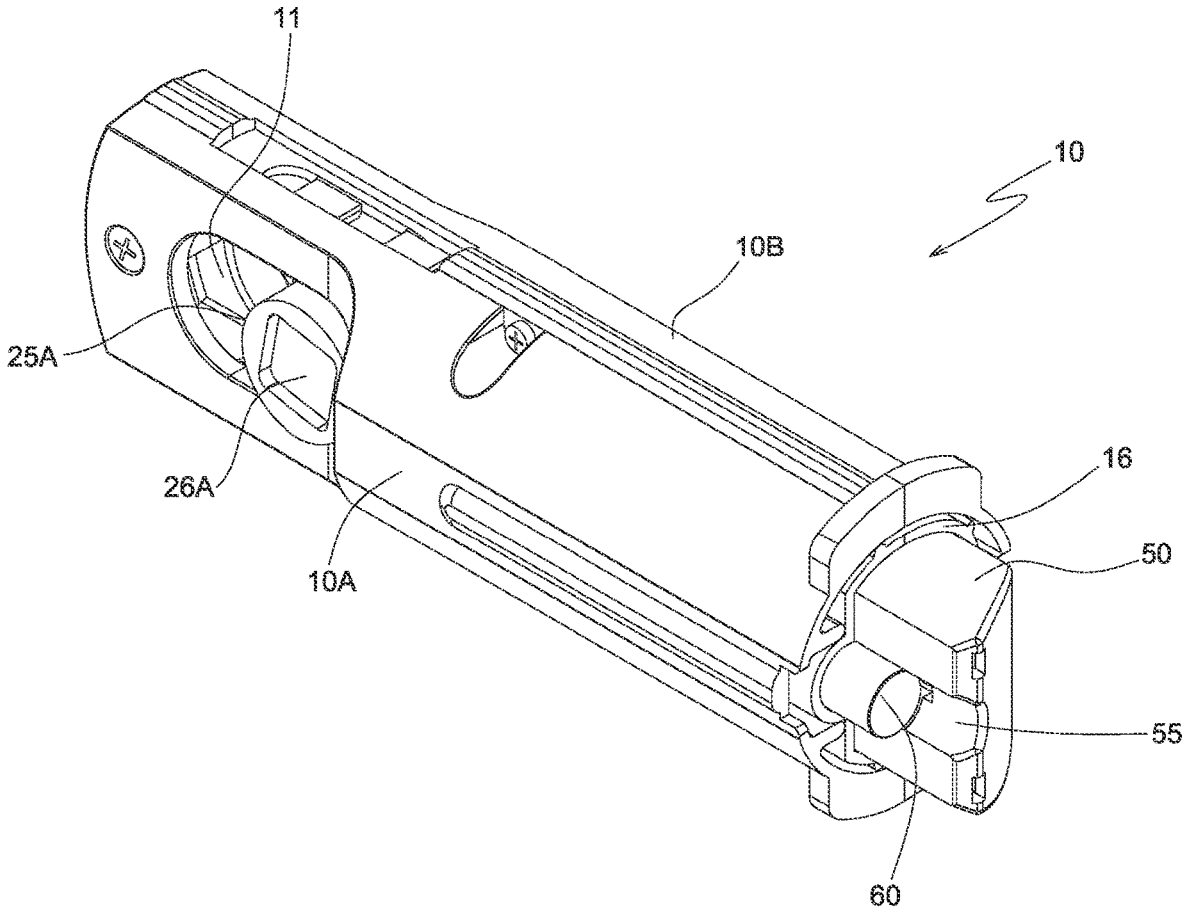
FIG. 18 is a perspective view showing the application of a latch of the control structure of the door lock according to the preferred embodiment of the present invention.
Figure 19:
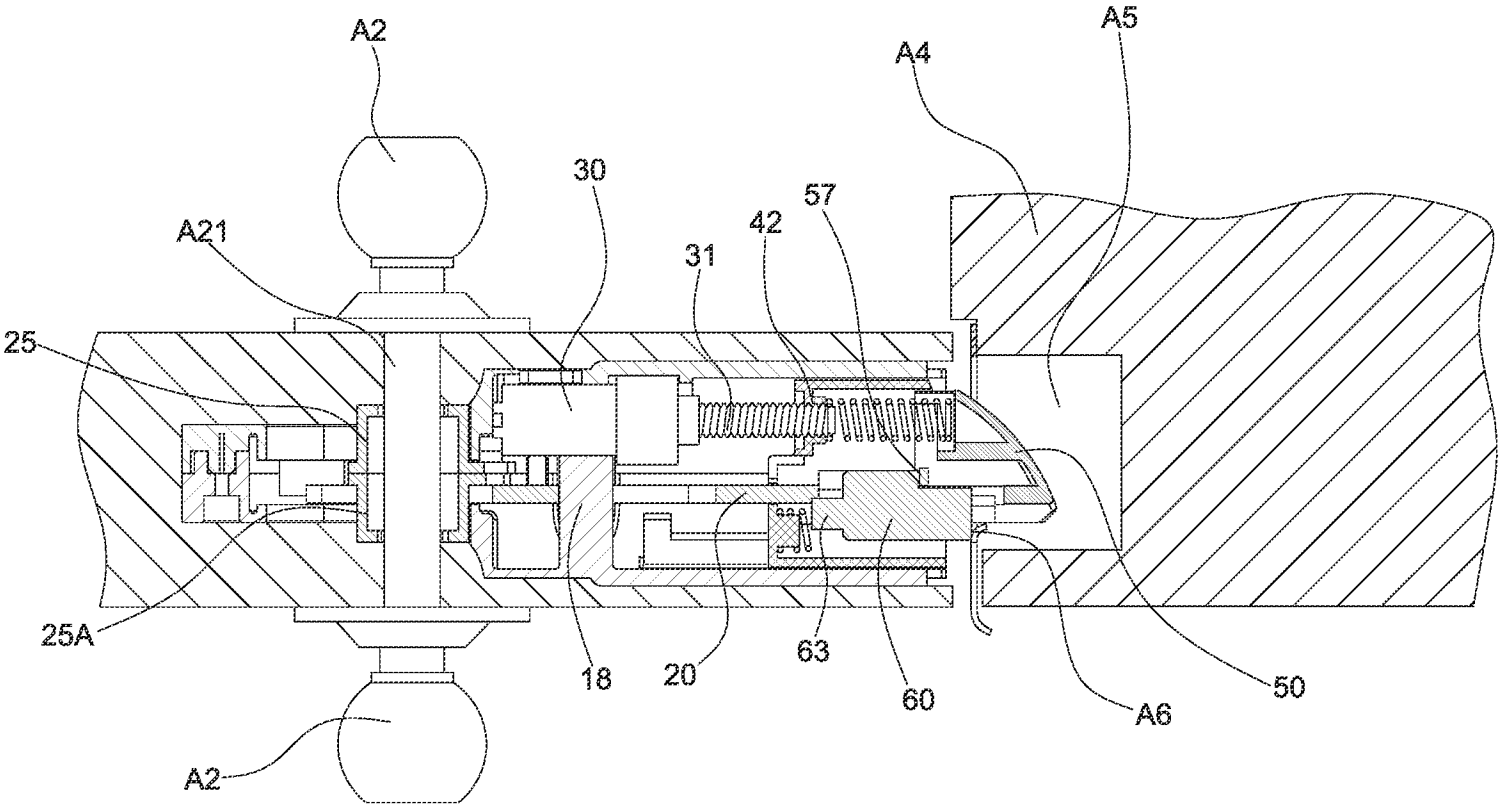
FIG. 19 is a cross sectional view showing the control structure of the door lock being applicable for the door and the door frame according to the preferred embodiment of the present invention.

As shown in FIGS. 17-19, the control structure of the door lock is accommodated in a door A3, and the deadbolt 50 and the latch 60 extend out of the door A3, wherein the door A3 has the control unit A1 arranged on an edge thereof, and the control unit A1 has a control chip accommodated therein and configured to control the motor 30 to operate by using the controlling signal. The control structure of the door A3 mates with the deadbolt 50 and a contact sheet A6 of a door frame A4 to open or close the door A3. When the deadbolt 50 moves into a receiving orifice of the door frame A4, the contact sheet A6 forces the latch 60 to retract inward so that the lock fringe 61 of the latch 60 moves into the engagement segment 57 of the deadbolt 50 by using the guiding face 62, such that the deadbolt 50 is locked by the lock fringe 61 of the latch 60, and the deadbolt 50 does not move outward or backward with respect to the slide cylinder 40.

While various embodiments in accordance with the present invention have been shown and described, it is clear to those skilled in the art that further embodiments may be made without departing from the scope of the present invention.

What is claimed is:

1. A control structure of a door lock comprising:

a body including a first cap and a second cap, each of the first cap and the second cap being integrally formed, the body further including an open segment formed on a first end of the body, a close segment formed on a second end of the body, a drive space defined in the body, a holder formed inside the drive space of the body, a groove formed inside the body adjacent to the close segment, and an abutting post extending from the first cap;

a slidable partition accommodated in the body, and the slidable partition including a slot defined on a first end of the slidable partition and corresponding to the groove of the body, two first driving extensions separately extending above the slot, a second driving extension extending below the slot, a through hole defined on a predetermined position of an intermediate section of the slidable partition and receiving the abutting post, two symmetrical hooks extending from a second end of the slidable partition, a seat extending from the slot and corresponding to the groove of the body, a drive orifice defined in the seat, a first paw extending from a first end of the seat and corresponding to the two first spaced driving extensions of the slidable partition, a second paw extending from the first end of the seat and corresponding to the second driving extension, and a shaft extending from a second end of the seat opposite to the first end of the seat, wherein the shaft has a hole defined therein and corresponding to the drive orifice;

a motor accommodated in the holder of the body, the motor including a guide rod extending from a center of an end of the motor and received in the open segment of the body, wherein a side wall of the motor is positioned by the abutting post of the body;

a slide cylinder received in a predetermined position of the drive space of the body, the slide cylinder including an opening defined on a first end of the slide cylinder, a fixing segment formed on a second end of the slide cylinder, the fixing segment having a fence, a guide orifice defined on a side of the fence and configured to mesh with the guide rod of the motor, a trench formed proximate to the guide orifice, two troughs defined on a top and a bottom of the trench, wherein the trench and the two troughs accommodate the slidable partition, and the slide cylinder further includes at least one horizontal trench passing through the slot, a first positioning segment formed on the fence of the slide cylinder adjacent to the guide orifice, and a first locating protrusion formed on the fence of the slide cylinder away from the first positioning segment;

a deadbolt fixed in the body and movably received in the opening of the slide cylinder, and the deadbolt including a locking segment defined on a first end of the deadbolt, a chamber formed in a second end of the deadbolt, wherein the locking segment has a tip portion and a tilted face defined on a tip portion; the chamber has a second positioning segment corresponding to the first positioning segment of the slide cylinder, a notch defined on a side of the deadbolt, an engagement segment formed in the notch opposite to a center of the chamber, two retaining portions arranged on a top and a bottom of the chamber and corresponding to the two symmetrical hooks, and at least one locking tabs corresponding to and engaging with the at least one horizontal trench of the slide cylinder;

a latch accommodated in the notch of the deadbolt, the latch including a lock fringe formed on a side of the latch, and the latch further including a second location protrusion extending from a distal end of the latch;

a first resilient element, a first end of the first resilient element being positioned on the second positioning segment of the slide cylinder, and a second end of the first resilient element abutting against the first positioning segment of the deadbolt; and a second resilient element, a first end of the second resilient element being positioned on the first locating protrusion of the slide cylinder, and a second end of the second resilient element being fixed on the second location protrusion of the latch.

2. The control structure as claimed in claim 1, wherein the first cap and the second cap of the body are connected, the first cap has a first connection portion and a first coupling portion, the second cap has a second connection portion and a second coupling portion corresponding to the first connection portion and the first coupling portion, such that the first connection and the first coupling are connected by using a screw bolt, and the second connection portion and the second coupling portion are connected by way of another screw bolt, thus connecting the first cap and the second cap to produce the body.

3. The control structure as claimed in claim 1, wherein a slanted guiding face is formed on an edge of the locking lock fringe.

* * * * *